US006531826B1

(12) United States Patent
Ohno et al.

(10) Patent No.: US 6,531,826 B1
(45) Date of Patent: Mar. 11, 2003

(54) SELF-SCANNING LIGHT-EMITTING DEVICE

(75) Inventors: Seiji Ohno, Osaka (JP); Yukihisa Kusuda, Osaka (JP); Harunobu Yoshida, Osaka (JP); Ken Yamashita, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 0 days.

(21) Appl. No.: 09/830,042

(22) PCT Filed: Aug. 23, 2000

(86) PCT No.: PCT/JP00/05630

§ 371 (c)(1),
(2), (4) Date: Apr. 19, 2001

(87) PCT Pub. No.: WO01/14145

PCT Pub. Date: Mar. 1, 2001

(30) Foreign Application Priority Data

Aug. 24, 1999 (JP) ..... 11-236546
Mar. 1, 2000 (JP) ..... 2000-055139

(51) Int. Cl.[7] ..... G09G 3/10; B41J 2/435
(52) U.S. Cl. ..... 315/169.3; 347/237; 347/238
(58) Field of Search ..... 315/169.3, 169.1; 347/237, 238, 247

(56) References Cited

U.S. PATENT DOCUMENTS 5,177,405 A 1/1993 Kusuda et al. ..... 315/169.1
5,451,977 A * 9/1995 Kusuda et al. ..... 257/21
5,814,841 A * 9/1998 Kusuda et al. ..... 224/238
6,180,960 B1 * 1/2001 Kusuda et al. ..... 257/745
6,323,890 B1 * 11/2001 Muto et al. ..... 347/237

FOREIGN PATENT DOCUMENTS

| | | |
|---|---|---|
| EP | 0419255 A3 | 3/1991 |
| JP | 02263668 | 10/1990 |
| JP | 3-256372 | 11/1991 |
| JP | 4-273033 | 9/1992 |
| JP | 5-92615 | 4/1993 |
| JP | 6-297769 | 10/1994 |
| JP | 8-39860 | 2/1996 |
| JP | 8-197773 | 8/1996 |
| WO | WO97/12405 | 4/1997 |

OTHER PUBLICATIONS

PCT International Search Report, Nov. 21, 2000.
Supplementary European Search Report, Feb. 20, 2002.

* cited by examiner

*Primary Examiner*—Don Wong
*Assistant Examiner*—Thuy Vinh Tran
(74) *Attorney, Agent, or Firm*—RatnerPrestia

(57) ABSTRACT

A self-scanning light-emitting device is provided in which the amounts of light of light-emitting elements may be corrected to make the distribution of amounts of light in a luminescent chip or among luminescent chips uniform. The correction for amounts of light of light-emitting elements may be carried out by regulating the time duration of on-state of a light-emitting element or the voltage of a write signal applied to a light-emitting element. According to the present invention, the distribution of amounts of light becomes uniform, so that the printing quality of a printer using such self-scanning light-emitting device is improved.

14 Claims, 15 Drawing Sheets

SELF-SCANNING LIGHT-EMITTING DEVICE

TECHNICAL FIELD

The present invention relates to generally a self-scanning light-emitting device, particularly to a self-scanning light-emitting device whose amount of light may be corrected.

BACKGROUND ART

A light-emitting device in which a plurality of light-emitting elements are arrayed on the same substrate is utilized as a light source of a printer, in combination with a driver circuit. The inventors of the present invention have interested in a three-terminal light-emitting thyristor having a pnpn-structure as an element of the light-emitting device, and have already filed several patent applications (see Japanese Patent Publication Nos. 1-238962, 2-14584, 292650, and 2-92651.) These publications have disclosed that a self-scanning function for light-emitting elements may be implemented, and further have disclosed that such selfscanning light-emitting device has a simple and compact structure for a light source of a printer, and has smaller arranging pitch of thyristors.

The inventors have further provided a self-scanning light-emitting device having such structure that an array of light-emitting thyristors having transfer function is separated from an array of light-emitting thyristors having writable function (see Japanese Patent Publication No. 2-263668.)

Referring to FIG. 1, there is shown an equivalent circuit diagram of a fundamental structure of this self-scanning light-emitting device. According to this structure, the device comprises transfer elements $T_1$, $T_2$, $T_3$ . . . and writable light-emitting elements $L_1$, $L_2$, $L_3$ . . . , these elements consisting of three-terminal light-emitting thyristors. The structure of the portion of an array of transfer elements includes diode $D_1$, $D_2$, $D_3$ . . . as means for electrically connecting the gate electrodes of the neighboring transfer elements to each other. $V_{GK}$ is a power supply (normally 5 volts), and is connected to all of the gate electrodes $G_1$, $G_2$, $G_3$ . . . of the transfer elements via a load resistor $R_L$, respectively. Respective gate electrodes $G_1$, $G_2$, $G_3$ . . . are correspondingly connected to the gate electrodes of the writable light-emitting elements $L_1$, $L_2$, $L_3$ . . . . A start pulse $\phi_s$ is applied to the gate electrode of the transfer element $T_1$, transfer clock pulses $\phi$1 and $\phi$2 are alternately applied to all of the anode electrodes of the transfer elements, and a write signal $\phi_I$ is applied to all of the anode electrodes of the light-emitting elements. The self-scanning light-emitting device shown in FIG. 1 is a cathode common type, because all of the cathodes of the transfer elements and the light-emitting elements are commonly connected to the ground.

Referring to FIG. 2, there are shown respective wave shapes of the start pulse $\phi_s$, the transfer clock pulses $\phi$1, $\phi$2, and the write pulse signal $\phi_I$. The ratio (i.e., duty ratio) between the time duration of high level and that of low level in each of clock pulses $\phi$1 and $\phi$2 is substantially 1 to 1.

The operation of this self-scanning light-emitting device will now be described briefly. Assume that as the transfer clock $\phi$1 is driven to a high level, the transfer element $T_2$ is now turned on. At this time, the voltage of the gate electrode $G_2$ is dropped to a level near zero volts from 5 volts. The effect of this voltage drop is transferred to the gate electrode $G_3$ via the diode $D_2$ to cause the voltage of the gate electrode $G_3$ to set about 1 volt which is a forward rise voltage (equal to the diffusion potential) of the diode $D_2$. On the other hand, the diode $D_1$ is reverse-biased so that the potential is not conducted to the gate $G_1$, then the potential of the gate electrode $G_1$ remaining at 5 volts. The turn on voltage of the light-emitting thyristor is approximated to a gate electrode potential+a diffusion potential of PN junction (about 1 volt.) Therefore, if a high level of a next transfer clock pulse $\phi$2 is set to the voltage larger than about 2 volts (which is required to turnon the transfer element $T_3$) and smaller than about 4 volts (which is required to turn on the transfer element $T_5$), then only the transfer element $T_3$ is turned on and other transfer elements remain off-state, respectively. As a result of which, on-state is transferred from $T_2$ to $T_3$. In this manner, on-state of transfer elements are sequentially transferred by means of two-phase clock pulses.

The start pulse $\phi_s$ works for starting the transfer operation described above. When the start pulse $\phi_s$ is driven to a low level (about 0 volt) and the transfer clock pulse $\phi$2 is driven to a high level (about 2–4 volts) at the same time, the transfer element $T_1$ is turned on. Just after that, the start pulse $\phi_s$ is returned to a high level.

Assuming that the transfer element $T_2$ is in the on-state, the voltage of the gate electrode $G_2$ is lowered to almost zero volt. Consequently, if the voltage of the write signal $\phi_I$ is higher than the diffusion potential (about 1 volt) of the PN junction, the light-emitting element $L_2$ may be turned into an on-state (a light-emitting state).

On the other hand, the voltage of the gate electrode $G_1$, is about 5 volts, and the voltage of the gate electrode $G_3$ is about 1 volt. Consequently, the write voltage of the light-emitting element $L_1$ is about 6 volts, and the write voltage of the light-emitting element $L_3$ is about 2 volts. It follows from this that the voltage of the write signal $\phi_I$ which can write into only the light-emitting element $L_2$ is in a range of about 1–2 volts. When the light-emitting element $L_2$ is turned on, that is, in the light-emitting state, the amount of light thereof is determined by the write signal $\phi_I$. Accordingly, the light-emitting elements may emit light at any desired amount of light. In order to transfer on-state to the next element, it is necessary to first turn off the element in on-state by temporarily dropping the voltage of the write signal $\phi_I$ down to zero volts.

The self-scanning light-emitting device described above may be fabricated by arranging a plurality of luminescent chips each thereof is for example 600 dpi (dots per inch)/128 light-emitting elements and has a length of about 5.4 mm. These luminescent chips may be obtained by dicing a wafer in which a plurality of chips are fabricated. While the distribution of amounts of light of light-emitting elements in one chip is small, the distribution of amounts of light among chips is large. Referring to FIGS. 3A and 3B, there is shown an example of the distribution of amounts of light in a wafer. FIG. 3A shows a plan view a three-inch wafer 10, wherein an x-y coordinate system is designated. The light-emitting elements are arranged in a direction of x-axis, and the length of one luminescent chip is about 5.4 mm. FIG. 3B shows the distribution of amounts of light at locations in the x-y coordinate system. It should be noted in FIG. 3B that the amount of light is normalized by an average value within a wafer. In FIG. 3B, four distributions of amounts of light are shown, with y-locations being different (i.e., y=0, 0.5, 1.0, and 1.35 inches).

It is apparent from FIG. 3B that each distribution of amounts of light in a chip is within the deviation of at most ±0.5% except chips around the extreme peripheral part of a wafer, but the average values of amounts of light in respective chips on a wafer are distributed in a range of the deviation of about 6%, because the amounts of light in a wafer are distributed like the shape of the bottom of a pan as shown in FIG. 3B. It has been noted that another wafers have distributions similar to that of FIG. 3B, and average values of amounts of light are varied among wafers. In this manner, while the amounts of light are distributed in a small range in a chip, the average values of amount of light of respective chips in a wafer are distributed broadly.

Therefore, a self-scanning light-emitting device having a uniform distribution of amounts of light has provided heretofore by arranging luminescent chips whose average values of amounts of light are substantially the same. For example, in order to hold the distribution of average values of amounts of light of chips constituting one self-scanning light-emitting device into the deviation of ±1%, luminescent chips are required to be grouped into a plurality of ranks each having ±1% deviation of average values of amounts of light to arrange chips included in the same rank in fabricating a self-scanning light-emitting device (see Japanese Patent Publication No. 9-319178).

In fact, the resistance of resistors in the self-scanning light-emitting device and the output impedance of a driver circuit for the self-scanning light-emitting device have errors, respectively, so that the deviation of average value of amounts of light for one rank is required to further be decreased. In order to decrease the dispersion of the output impedance of a driver circuit, the output impedance itself is needed to be decreased, resulting in increasing of the area of a chip and the cost thereof. Furthermore, when the self-scanning light-emitting device is used for an optical device such as a printer, the accuracy of a lens system is required.

If the number of ranks for average values of amounts of light is large, the work for grouping chips into ranks is not only very complicated but also has a poor manufacturing efficiency because many kinds of stoked chips are required.

DISCLOSURE OF INVENTION

The object of the present invention is to provide a self-scanning light-emitting device in which the distribution of amounts of light may be corrected in a chip or among chips by regulating the amount of light for a light-emitting element.

According to a first aspect of the present invention, a self-scanning light-emitting device is provided, this device comprising: a self-scanning transfer element array having such a structure that a plurality of three-terminal transfer elements each having a control electrode for controlling threshold voltage or current are arranged, the control electrodes of the transfer elements neighbored to each other are connected via first electrical means, a power supply line is connected to the control electrodes via second electrical means, and clock lines are connected to one of two terminals other than the control electrode of each of the transfer elements; a light-emitting element array having such a structure that a plurality of three-terminal light-emitting elements each having a control electrode for controlling threshold voltage or current are arranged, the control electrodes of the light-emitting element array are connected to the control electrodes of the transfer element array, and a line for applying a write signal connected to one of two terminals other than the control electrode of each of the light-emitting elements is provided; and a driver circuit for regulating the time duration of on-state of each of the light-emitting elements to correct amounts of light so as to make the distribution of amounts of light uniform.

According to a second aspect of the present invention, a self-scanning light-emitting device is provided, this device comprising: a self-scanning transfer element array having such a structure that a plurality of three-terminal transfer elements each having a control electrode for controlling threshold voltage or current are arranged, the control electrodes of the transfer elements neighbored to each other are connected via first electrical means, a power supply line is connected to the control electrodes via second electrical means, and clock lines are connected to one of two terminals other than the control electrode of each of the transfer elements; a light-emitting element array having such a structure that a plurality of three-terminal light-emitting elements each having a control electrode for controlling threshold voltage or current are arranged, the control electrodes of the light-emitting element array are connected to the control electrodes of the transfer element array, and a line for applying a write signal connected to one of two terminals other than the control electrode of each of the light-emitting elements is provided; and a driver circuit for regulating the voltage of the write signal applied to each of the light-emitting elements to correct amounts of light thereof so as to make the distribution of amounts of light uniform.

DESCRIPTION OF A PREFERRED EMBODIMENT

The embodiments of the present invention will now be described with reference to the drawings.

First Embodiment

The present embodiment is directed to a self-scanning light-emitting device in which the time duration of on-state of each of the light-emitting elements is regulated to correct amounts of light so as to make the distribution of amounts of light uniform.

Figure 4:
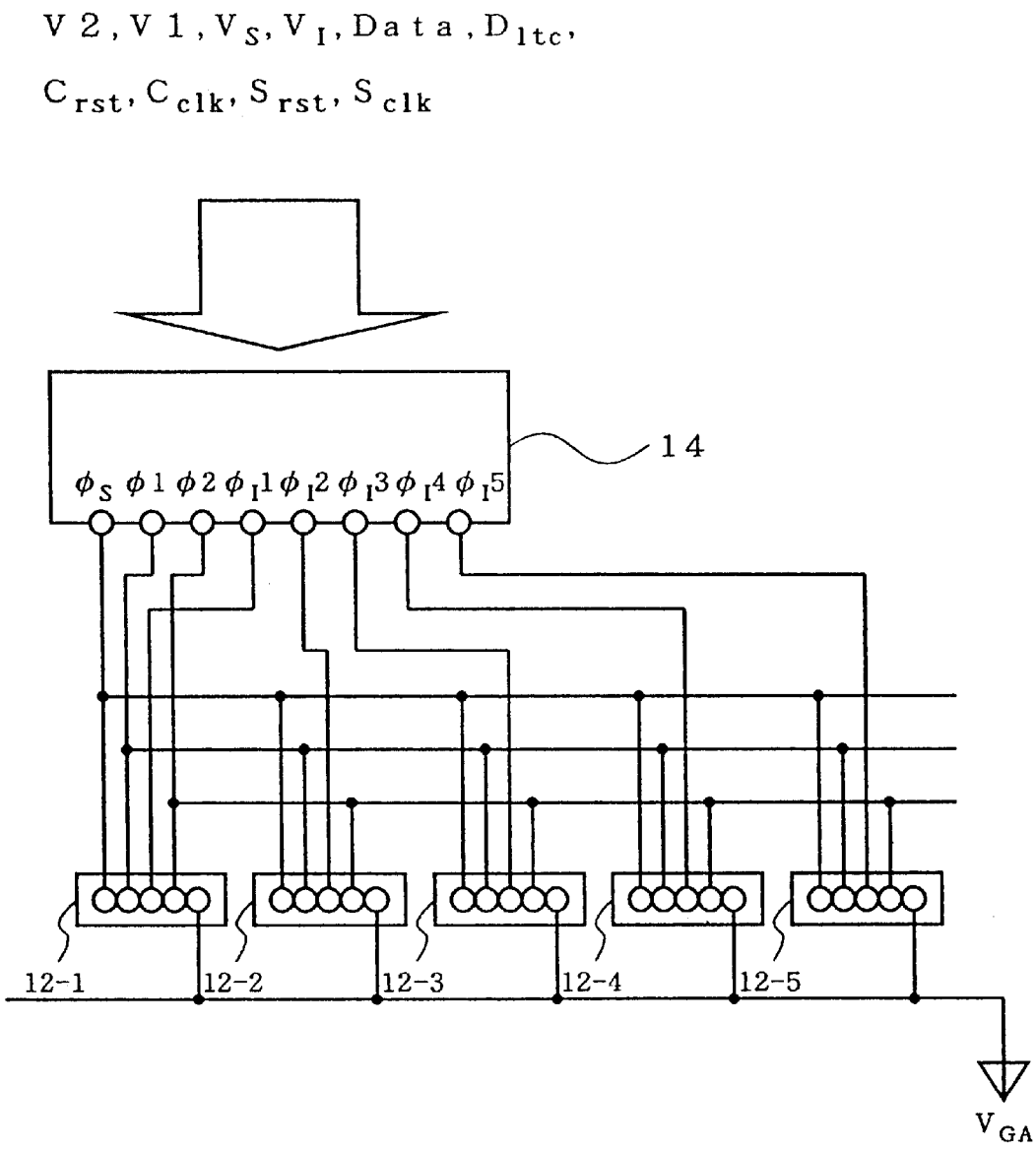
FIG. 4 shows a driver circuit for driving a chip of "an anode common, two-phase driving self-scanning light-emitting device".

Referring to FIG. 4, there is shown a driver circuit for driving luminescent chips of "an anode common, two-phase driving self-scanning light-emitting device". A driver circuit 14 for driving five luminescent chips 12-1, 12-2, . . . , 12-5 supplies a start pulse $\phi_s$ and two-phase clock pulses $\phi$1, $\phi$2 to each chip, respectively. The driver circuit 14 also supplies a write signal $\phi_I$1, $\phi_I$2, $\phi_I$3, $\phi_I$4 and $\phi_I$5 to each chip, respectively.

Figure 1:
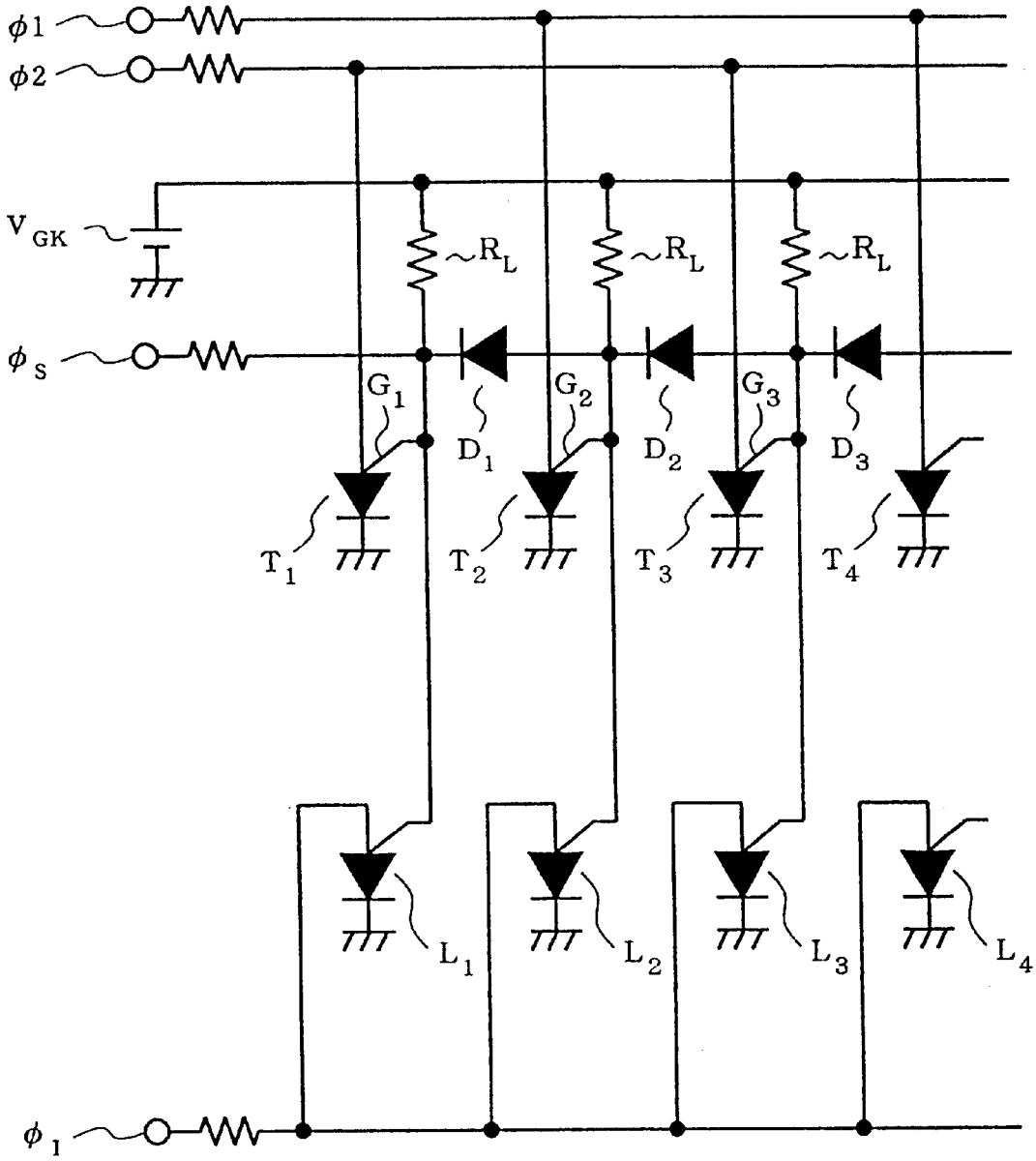
F I G. 1 PRIOR ART
FIG. 1 is an equivalent circuit diagram of a self scanning light-emitting device.
Figure 2:
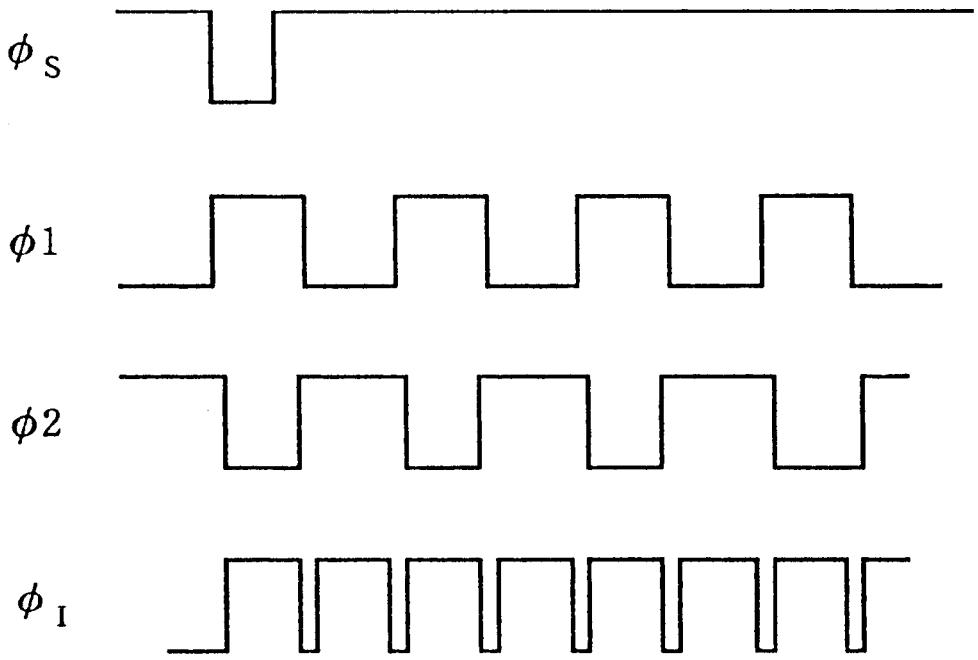
F I G. 2 PRIOR ART
FIG. 2 is a wave shape diagram of the signals of the circuit shown in FIG. 1.
Figure 3A:
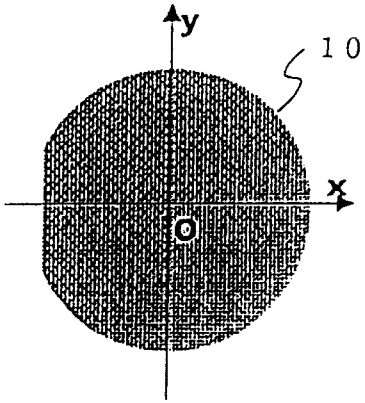
FIG. 3A PRIOR ART
FIGS. 3A and 3B are diagrams illustrating an example of the distribution of amounts of light in a wafer.
Figure 3B:
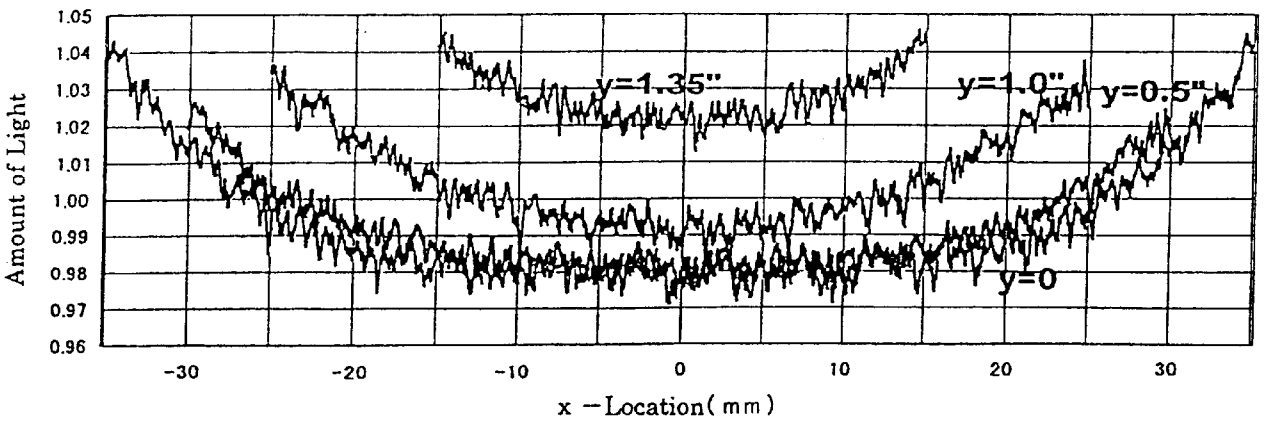
FIG. 3B PRIOR ART
Figure 5:
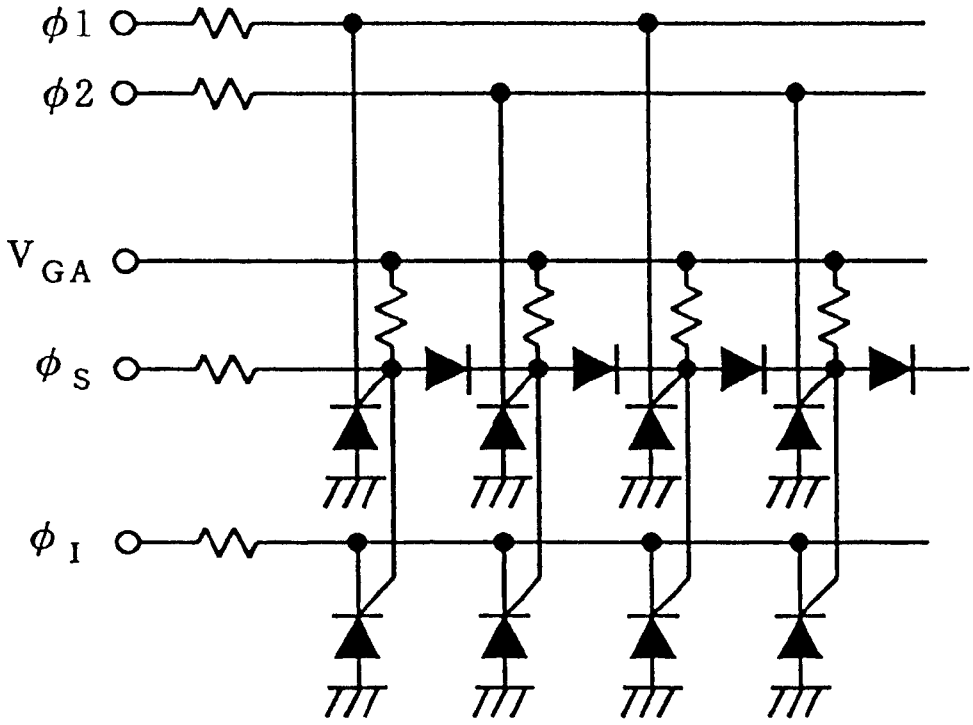
FIG. 5 is an equivalent circuit diagram of one luminescent chip.

Referring to FIG. 5, there is shown a equivalent circuit diagram of one luminescent chip. Different to the circuit shown in FIG. 1, this circuit is an anode common circuit in which all of the anodes of the transfer elements and light-emitting elements are commonly connected to the ground. Consequently, it should be noted that each polarity of the start pulse $\phi_s$, the two-phase clock pulses $\phi$1, $\phi$2, and the write signal $\phi_I$ is opposite to that of the signals shown in FIG. 2. $V_{GA}$ in FIG. 5 designates a supply voltage and the polarity thereof is opposite to that of $V_{GK}$ in FIG. 1.

Figure 6:
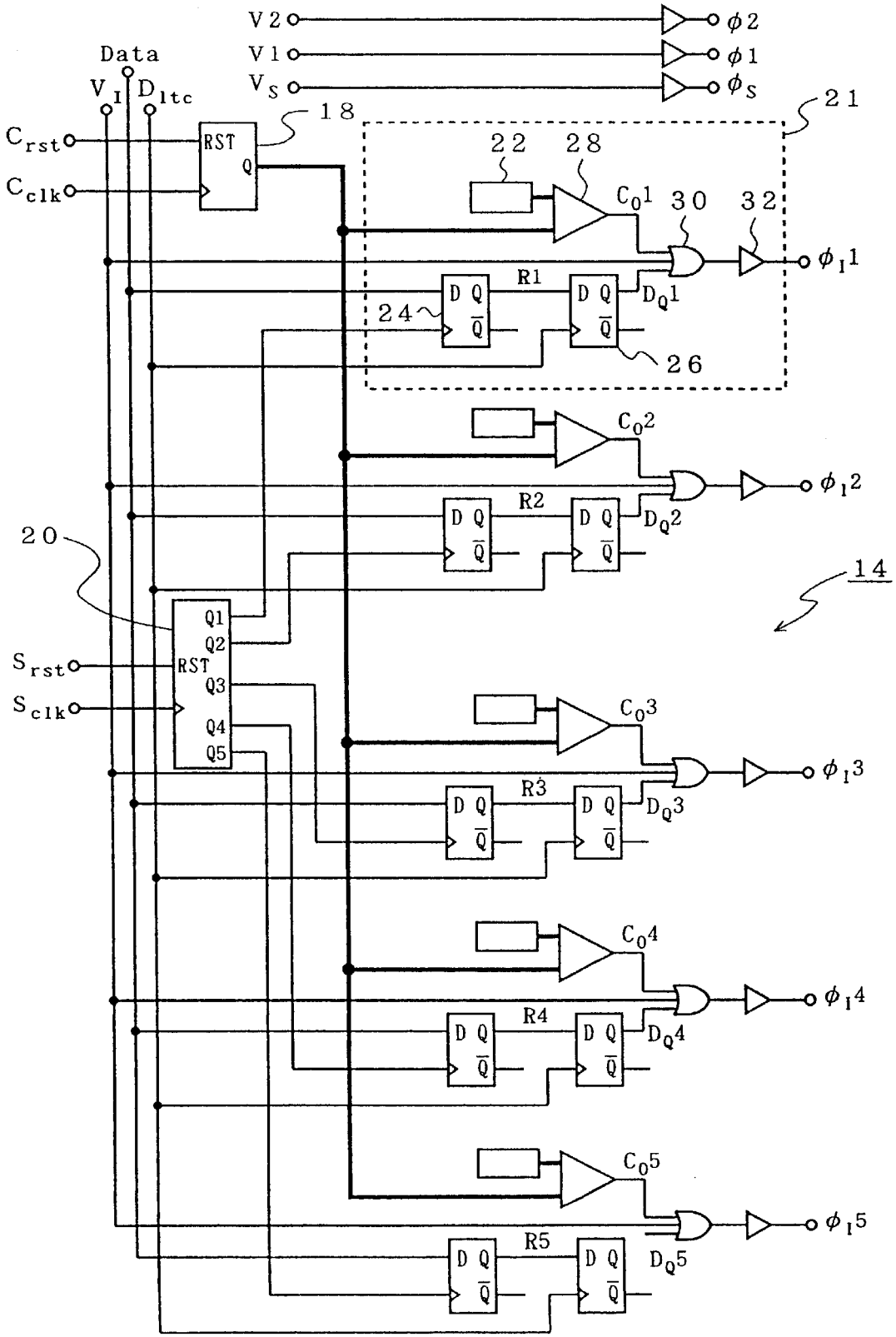
FIG. 6 shows the structure of a driver circuit

Referring to FIG. 6, there is shown the structure of the driver circuit 14. The driver circuit 14 comprises a counter 18, a shift register 20, and circuits for generating each write signal $\phi_I$1–$\phi_I$5, respectively. These circuits have the same structure, then the circuit 21 for generating the write signal $\phi_I$1 is typically explained.

The circuit 21 comprise a Read Only Memory (ROM) 22, two-stage D-type flip-flops (D-FF) 24, 26, a comparator 28, an OR gate 30, and a buffer 32. A generation of a correction data stored in the ROM 22 will be explained hereinafter.

Figure 7:
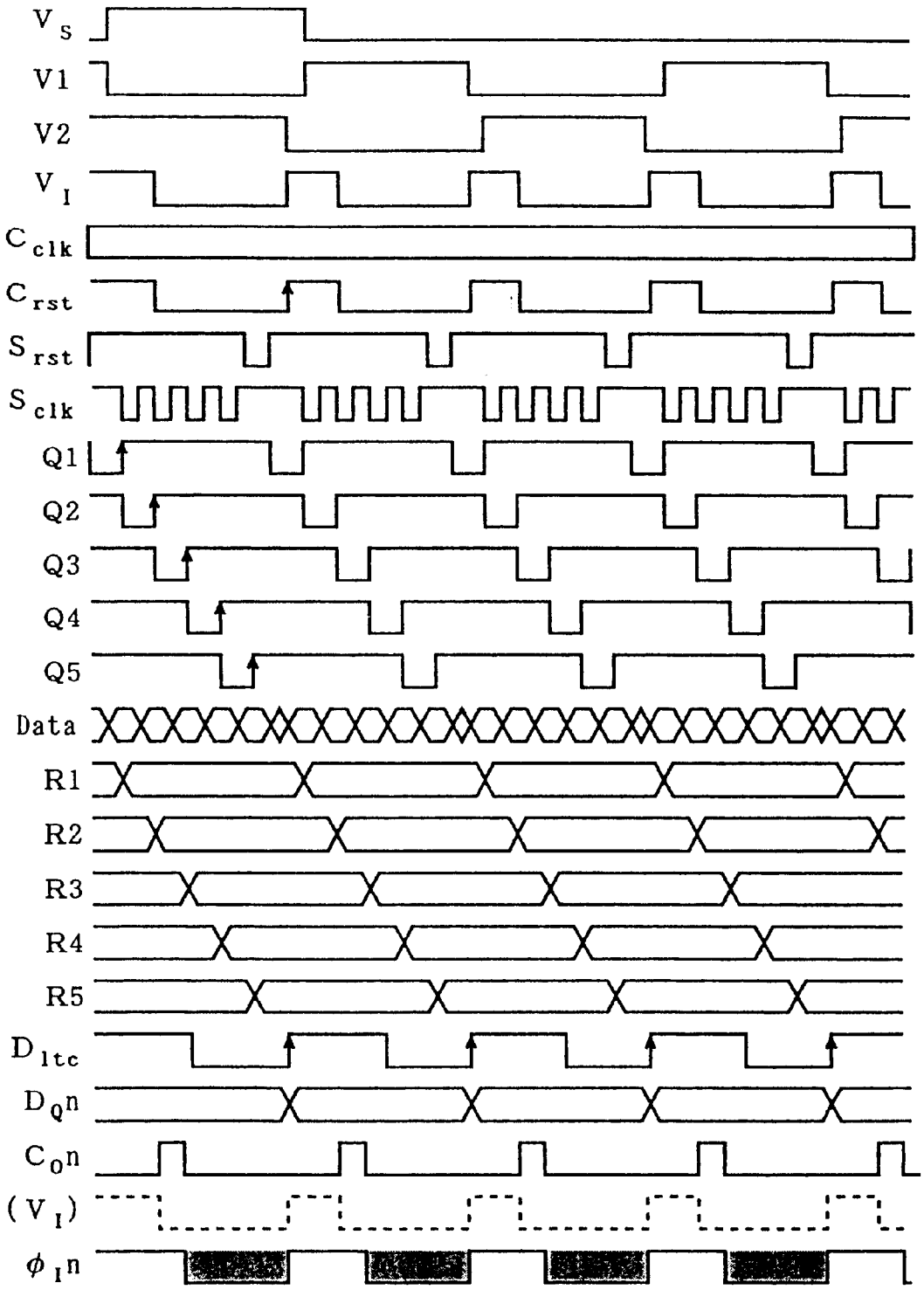
FIG. 7 is a timing diagram of input signals in the driver circuit.

Referring to FIG. 7, there is shown a timing diagram for each input signal in the driver circuit 14. The operation of the driver circuit will now be described with reference to this timing diagram. In the driver circuit 14, the pulses $\phi$1, $\phi$2, and 100$_s$ are obtained by passing input signals v1, v2 and $V_s$ as they are. A data signal "Data" includes five data in one period of the input signal $V_I$. Each data includes a designation for emitting light/not emitting light at its timing to each luminescent chip. The level of the data signal is held as a data R1 to the first stage D-FF 24 at the leading edge of an output signal Q1 from the shift register 20. The stored data R1 is then held to the second stage D-FF 26 at the leading edge of an input signal $D_{ltc}$.

The counter 18 counts the number of leading edges of a fundamental clock $C_{clk}$ since a reset pulse $C_{rst}$ rises. The output signal from the counter 18 is compared with the value of the correction data from the ROM 22. When the counted value becomes larger than the value of the correction data, an output signal $C_o$1 is driven to a low level.

An output signal $D_Q$1 from the second stage D-FF 26, the output signal $C_o$1 from the comparator 28, and an input signal $V_I$ are ORed at the OR gate 30 to generate a write signal $\phi_I$1.

Figure 8:
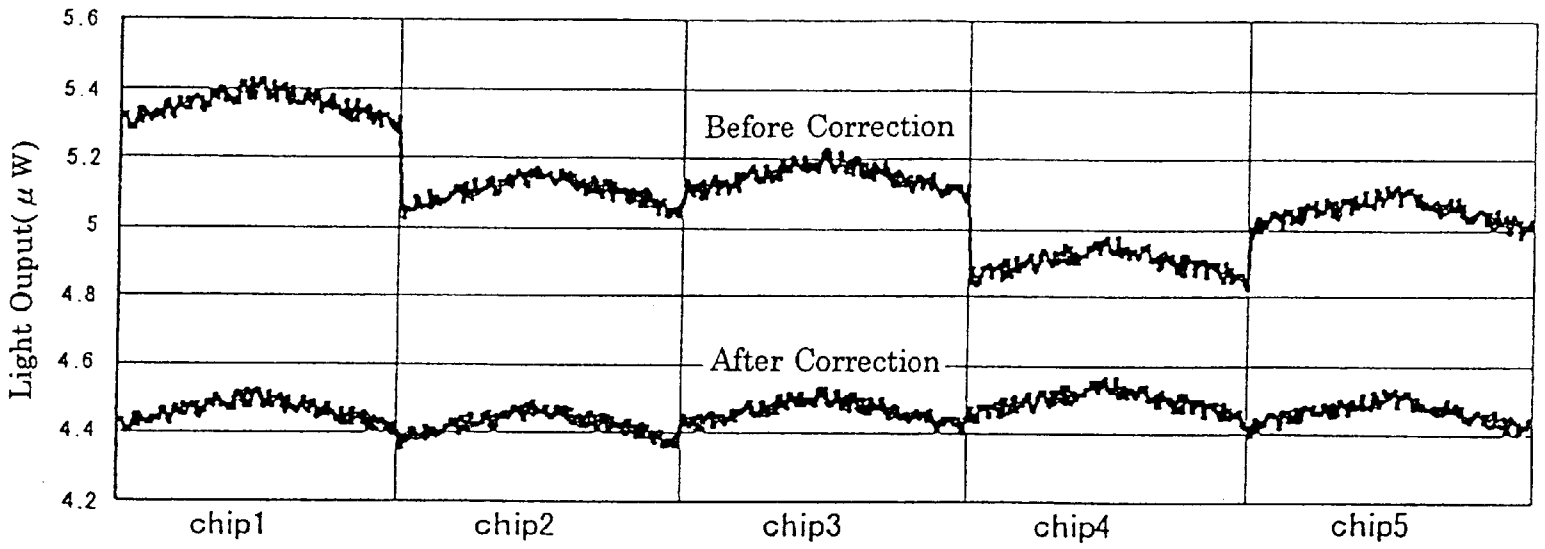
FIG. 8 shows the measurements of amounts of light before and after correction.

An experiment has been implemented for the case that the period of the clock $C_{clk}$ is 20 ns, the period of the input signal $V_I$ is 1500 ns, and the time duration when the input signal $V_I$ is at a low level is 1200 ns. At first, the correction data of all of the ROMs was set to "0", and the amounts of light (i.e., light output) were measured to the five chips, with all of the light-emitting elements being on-state. The result is shown in FIG. 8 as measurements before correction. In the figure, a light output is designated by power ($\mu$W) averaged in time. According to the measurements before correction, it is understood that the dispersion of the amounts of light among chips (chip 1, chip 2, . . . , chip 5) is large.

Based on the measurements before correction, a correction data was determined so that an average value of amounts of light of each chip is 4.5 $\mu$W. The correction data $D_E$n for the nth chip was obtained according to the following formula.

$D_E$n=75-int(60×4.5 $\mu$W/average value of amounts of light of the nth chip)

Wherein "int" is a function which represents an integer part of the numerical value in parentheses, the numeral "75"=$V_I$ period/$C_{clk}$ period, and the numeral "60"=(the time duration when the signal $V_I$ is at a low level)/$C_{clk}$ period.

The correction data $D_E$n for each chip thus obtained was stored into the ROM 22. Next, the amounts of light were measured to the five chips, with all of the light-emitting elements being on-state. The result is shown in FIG. 8 as measurements after correction.

Table 1 shows the average light output before and after correction for each chip, and the deviation of the average light output, which are calculated from the measurements shown in FIG. 8, together with the value of the correction data.

TABLE 1

| | | chip 1 | chip 2 | chip 3 | chip 4 | chip 5 | Average |
|---|---|---|---|---|---|---|---|
| Before Correction | Light Output ($\mu$W) | 5.349 | 5.101 | 5.149 | 4.900 | 5.051 | 5.110 |
| | Deviation (%) | 4.67 | −0.18 | 0.76 | −4.11 | −1.15 | −0.00 |
| After Correction | Light Output ($\mu$W) | 4.457 | 4.421 | 4.462 | 4.492 | 4.462 | 4.459 |
| | Deviation (%) | −0.03 | −0.85 | 0.08 | 0.74 | 0.07 | 0.00 |
| Correction Data | | 25 | 23 | 23 | 20 | 22 | |

It is understood from the Table 1 that the distribution of amounts of light of the five chips may be corrected so as to be within a deviation of ±1%.

The present embodiment is based on the recognition that the correction for amounts of light is enough to carry out among chips, because the distribution of amounts of light is small in a chip. Correction data are held every chip, and respective time durations for light-emitting elements are regulated based on the correction data to make the average value of amounts of light among chips uniform.

Second Embodiment

The present embodiment is directed to a self-scanning light-emitting device in which the voltage of a write signal applied to each of the light-emitting element is regulated to correct amounts of light thereof so as to make the distribution of amounts of light uniform.

Figure 9:
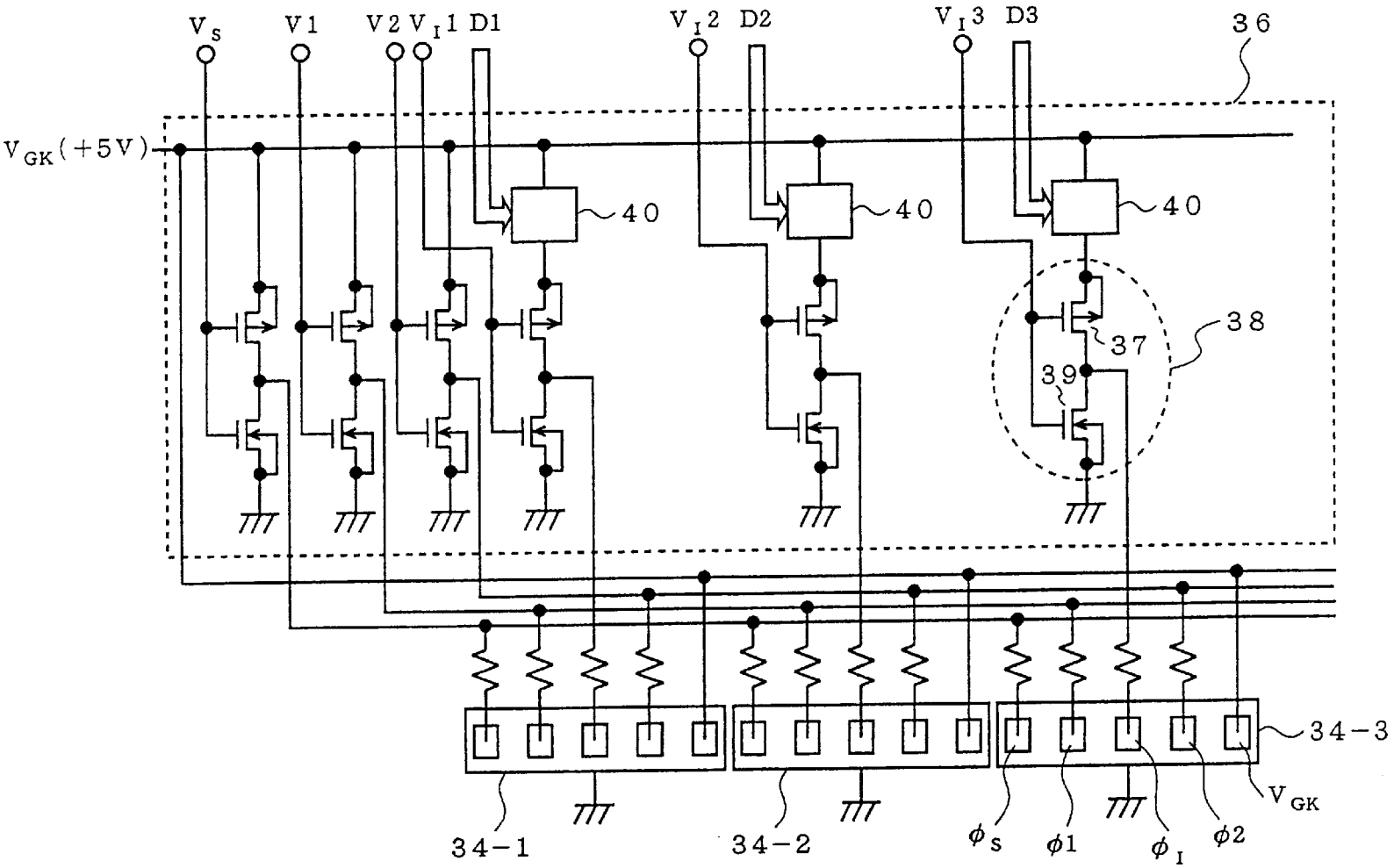
FIG. 9 shows a driver circuit for driving chips of "a cathode common, two-phase driving self-scanning light-emitting device".

Referring to FIG. 9, there is shown a driver circuit 36 for driving chips 34 of "a cathode common, two-phase driving self-scanning light-emitting device". In the figure, three luminescent chips 34-1, 34-2, and 34-3 are illustrated. The driver circuit 36 for driving these chips supplies a start pulse $\phi_s$, two-phase clock pulses $\phi$1, $\phi$2, a write signal $\phi_I$, a supply voltage $V_{GK}$ to each chip, respectively.

The driver circuit 36 comprises CMOS inverter-type buffers 38 for each of signals $\phi_s$, $\phi$1, $\phi$2 and $\phi_I$, each buffer being composed of an NMOS transistor 37 and a PMOS transistor 39. Especially, the buffer for the write signal $\phi_I$ is further provided with a digital/analog converter (DAC) 40 for outputting a voltage at its power supply side.

The DAC 40 is composed of 8-bit DAC to output the voltage of OV when a digital value of an input signal D1, D2 or D3 is "00H" and the voltage of 5V when the digital value is "FFH". The voltage value smaller than 1.5V is not used in the DAC 40, because the voltage of the write signal $\phi_I$ to turn on a light-emitting element is about 1.5V. Assuming that the light output of a light-emitting element is proportional to the value of voltage supplied to the anode thereof, $$(5V-1.5V)/5V\times 255 \text{ levels}=178.5 \text{ levels}$$

is established. Therefore, 178 levels of light outputs may be implemented by varying a digital input value for the DAC.

In FIG. 9, there are shown input signals to the driver circuit 36, i.e. input signals $V_s$, V1, V2, ($V_I$1, $V_I$2, $V_1$3), and (D1, D2, D3). The input signal $V_I$1, $V_I$2 and $V_I$3 are the signals to generate the write signal $\phi_I$ for each chip, and the input signals D1, D2 and D3 are input digital signals (8 bits) that are correction data for respective chips.

Figure 10:
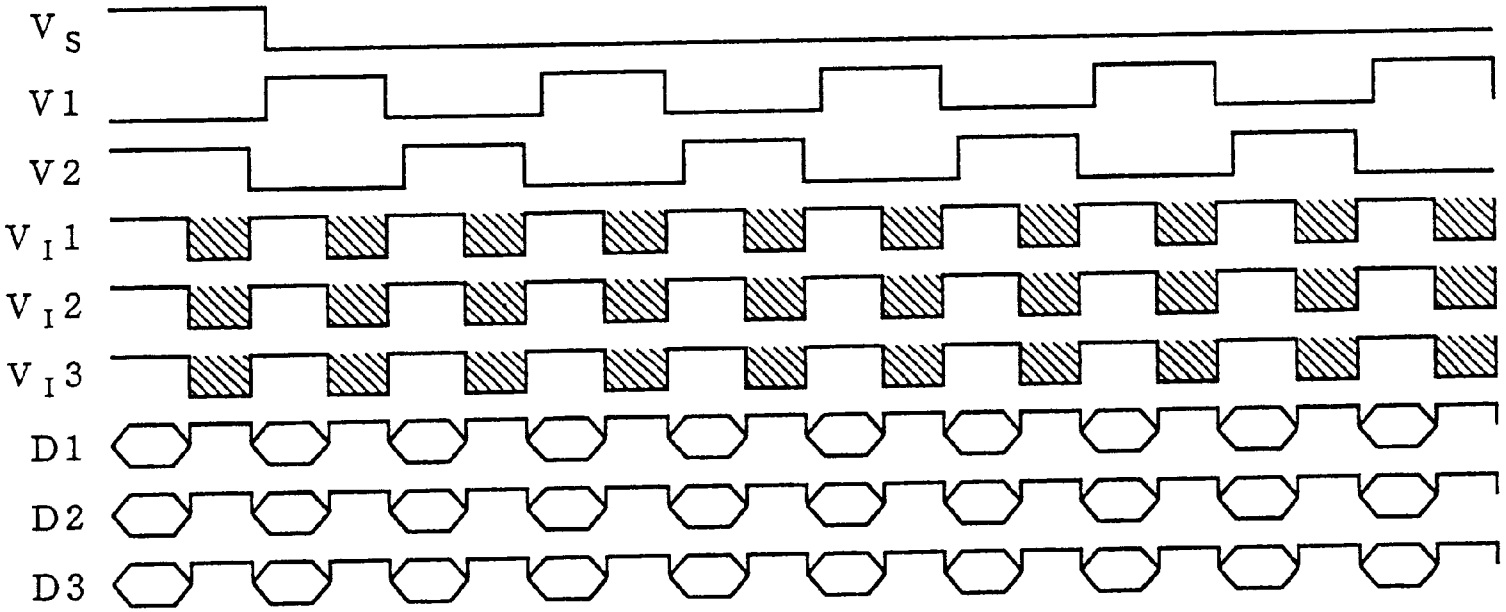
FIG. 10 is a timing diagram of input signals in the driver circuit shown in FIG. 9.

Referring to FIG. 10, there is shown a timing diagram for each input signal to the driver circuit 36. As stated above, the correction data D1, D2 and D3 are input to the DACs 40, respectively, to output the 178 levels of voltage. These output voltages may be sequentially written into all of the light-emitting elements at the timing of power-on of the buffers 38, i.e., at the timing of a low level of the input signal $V_I$1, $V_I$2 or $V_I$3. At this time, the correction for the amounts of light of all of the light-emitting elements may be implemented by selecting the correction data to vary respective voltage of write signals to the light-emitting elements.

In this manner, the correction for the amounts of light may be implemented to all of the light-emitting elements. It is also possible to correct the amounts of light among chips. In this case, the correction data is written into the DAC 40 at the timing of power-on and is held thereto.

According to the present embodiment, the correction for amounts of light may be implemented by modulating a voltage, so that a precision correction for amounts of light is possible.

Third Embodiment

Figure 11:
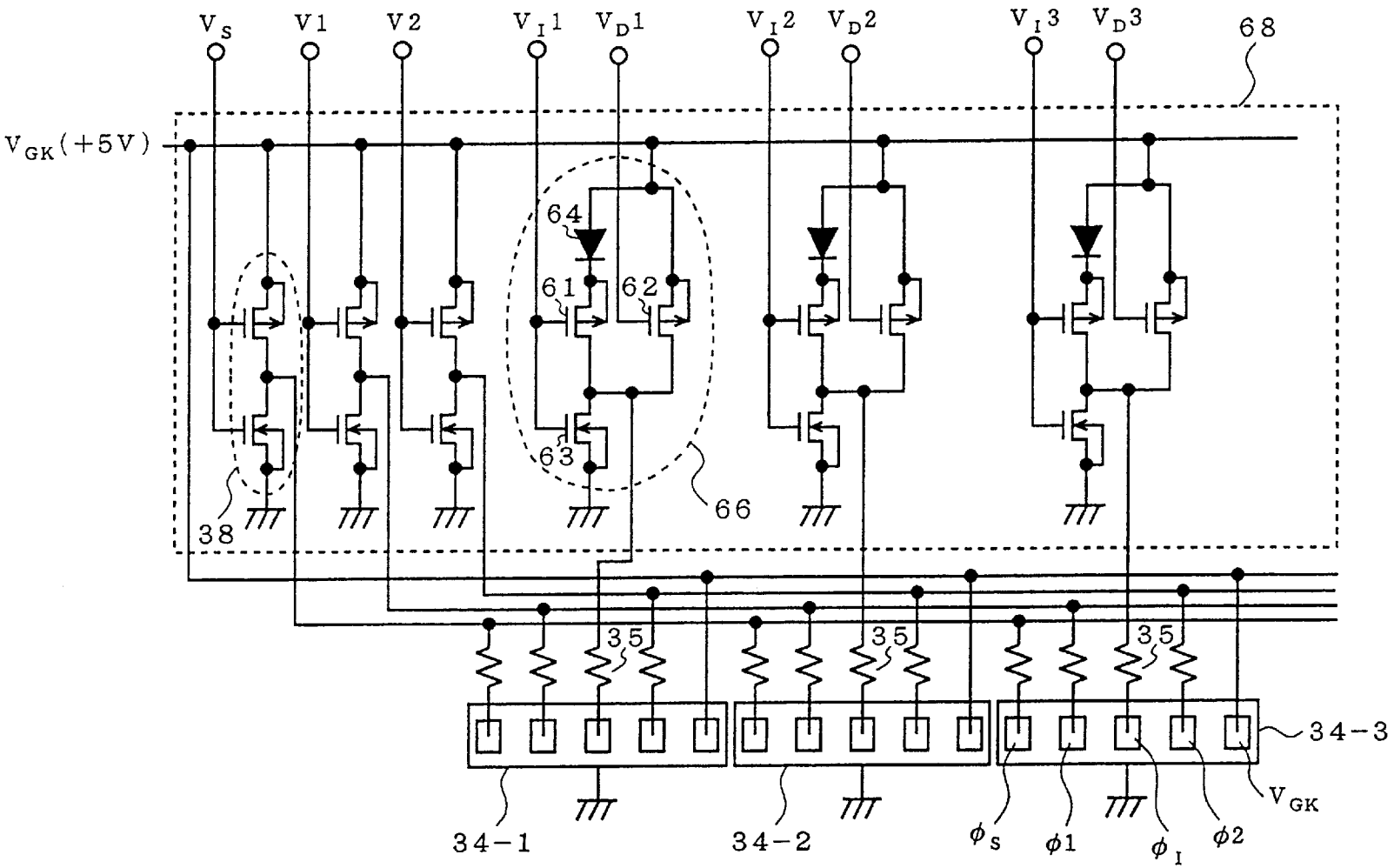
FIG. 11 shows another example of a driver circuit.

A driver circuit 68 shown in FIG. 11 is a variation of the driver circuit shown in FIG. 9. In this variation, a buffer for a write signal $\phi_I$ comprises a CMOS inverter (composed of an NMOS transistor 61 and a PMOS transistor 63) provided with a diode 64 for voltage shifting at a power supply side, and an NMOS transistor 62 connected parallel to a serial circuit of the diode 64 and the NMOS transistor 62. In the figure, this buffer is designated by reference numeral 66. The buffers for $\mathbf{100}_s$, $\phi$1 and $\phi$2 have the same structures as that of the buffers 38 in FIG. 9.

In FIG. 11, there are shown input signals to the driver circuit 68, i.e. input signals $V_s$, V1, V2,($V_I$1, $V_I$2, $V_I$3), and ($V_D$1, $V_D$2, $V_D$3), The input signals $V_D$1, $V_D$2 $V_D$3 are the signals to modulate the voltage of the write signal to each chip.

When the signal $V_I$1 is driven to a low level during a high level of the signal $V_D$1, only NMOS transistor 61 is turned on to supply a voltage via the diode 64 and the transistor 61 to a $\phi_I$ signal terminal of the chip 34-1. Since a forward rise voltage of a silicon diode is 0.6V, the output voltage of the buffer 66 becomes 4.4V when the supply voltage is 5V. On the other hand, when the signal $V_D$1 is driven to a low level during a low level of the signal $V_1$1, not only the NMOS transistor 61 but also the NMOS transistor 62 are turned on, so that the potential difference across the diode 64 becomes 0V and the diode is turned off. Therefore, the current path of the transistor 62 becomes effective and the output voltage of the buffer 66 is held at 5V of the supply voltage.

Since the ($\phi_I$ signal voltage to turn on a light-emitting element is 1.5V, when the signal $V_1$1 is low and the signal $V_D$1 is high, the $\phi_I$ signal current becomes $(4.4\text{-}1.5)/R_I$, on the other hand, when the signal $V_I$1 is low and the signal $V_D$1 is low, the $\phi_I$ signal current becomes $(5\text{-}1.5)/R_I$, wherein $R_I$ is a resistance of a current limiting resistor 35. It follows that the $\phi_I$ signal current when the signal $V_D$1 is at a high level is decreased by 17% compared with that when the signal $V_D$1 is low.

The correction of amounts of light for light-emitting elements is carried out by regulating a percentage of the time duration when the signal $V_D$1 is at a low level with respect to the time duration when the signal $V_I$1 is at a low level. According to this method, while the range to be regulated has only the range of 17% decrease of the $\phi_I$ signal current described above, the correction of amounts of light may be implemented at a resolution of $17\%/20\approx 1\%$ in the case that the time duration when the signal $V_I$1 is at a low level per light-emitting element is 400 ns and the period of a fundamental clock is 20 ns. When further width of the regulation range is required, the number of diodes may be increased such as 2, 3, . . . .

Figure 12:
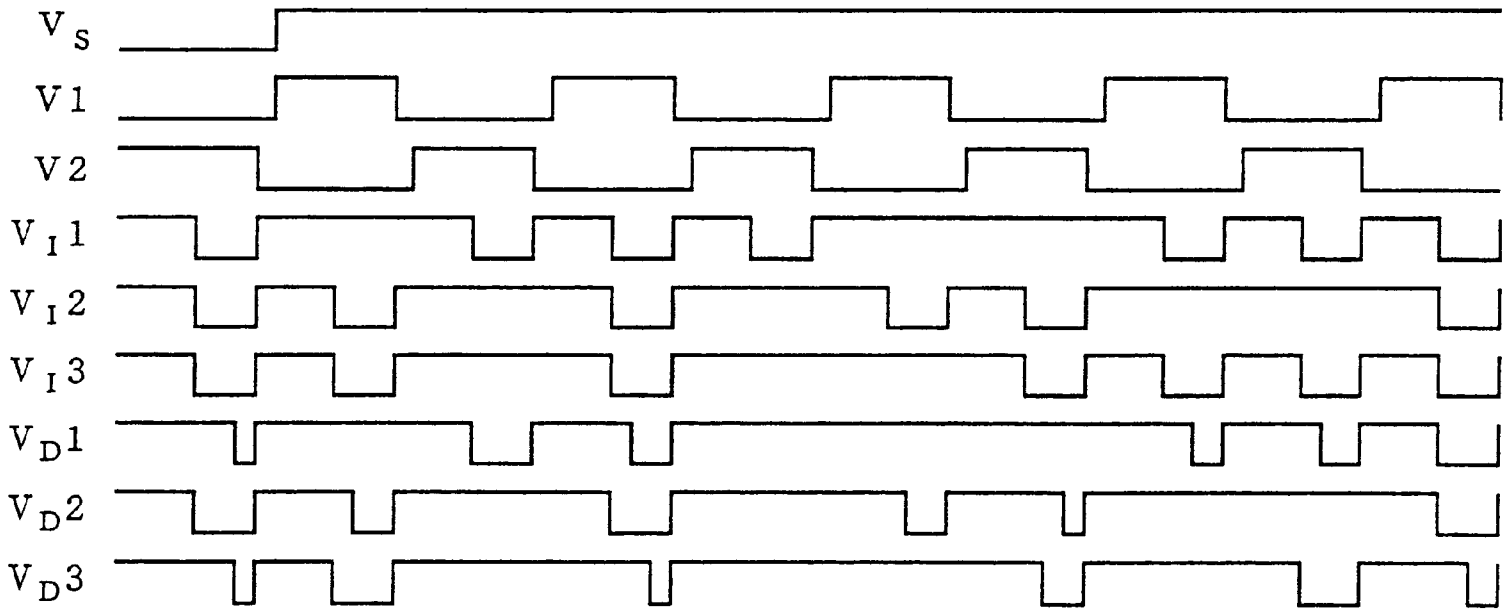
FIG. 12 is a timing diagram of signals for driving the driver circuit in FIG. 11.

Referring to FIG. 12, there is shown a timing diagram of signals for driving the driver circuit 68. It is apparent from this timing diagram that the time duration when each of the signals $V_D$1, $V_D$2 and $V_D$3 is at a low level is regulated during the time duration when each of the signals $V_I$1, $V_I$2, and $V_I$3 is at a low level.

Figure 13:
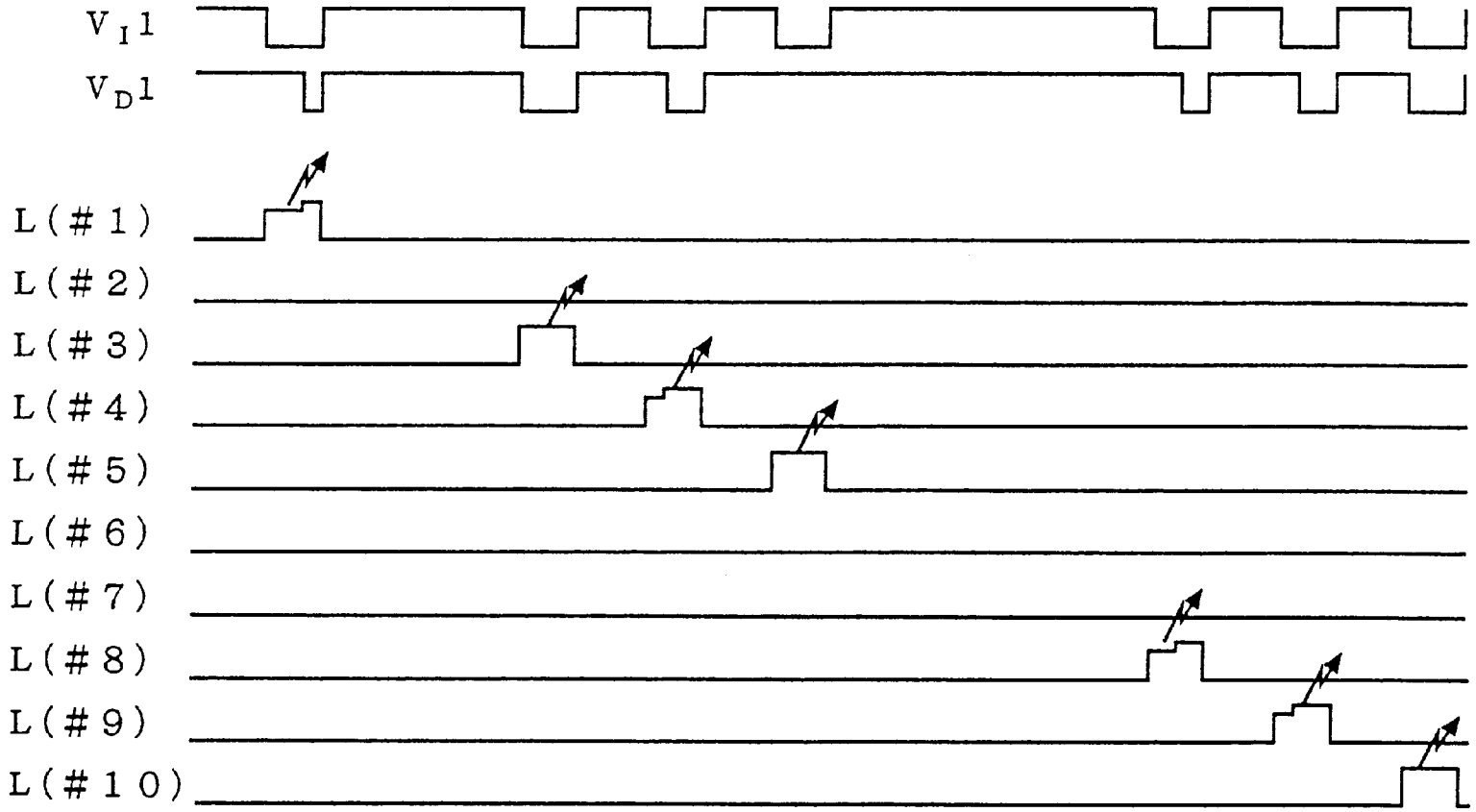
FIG. 13 shows how the light output of each of light-emitting elements is varied by the input signals.

FIG. 13 shows how the light output of each of light-emitting elements is varied by an example of the timing of the input signals. In FIG. 13, the light outputs are shown with respect to the signals $V_I$1 and $V_D$1, and L(#n) shows the light output of nth light-emitting element in the first chip (i.e., the chip on the left side in FIG. 11). It would be understood that the amounts of light may be corrected by regulating the time duration when the signal $V_D$1 is at a low level.

Figure 14:
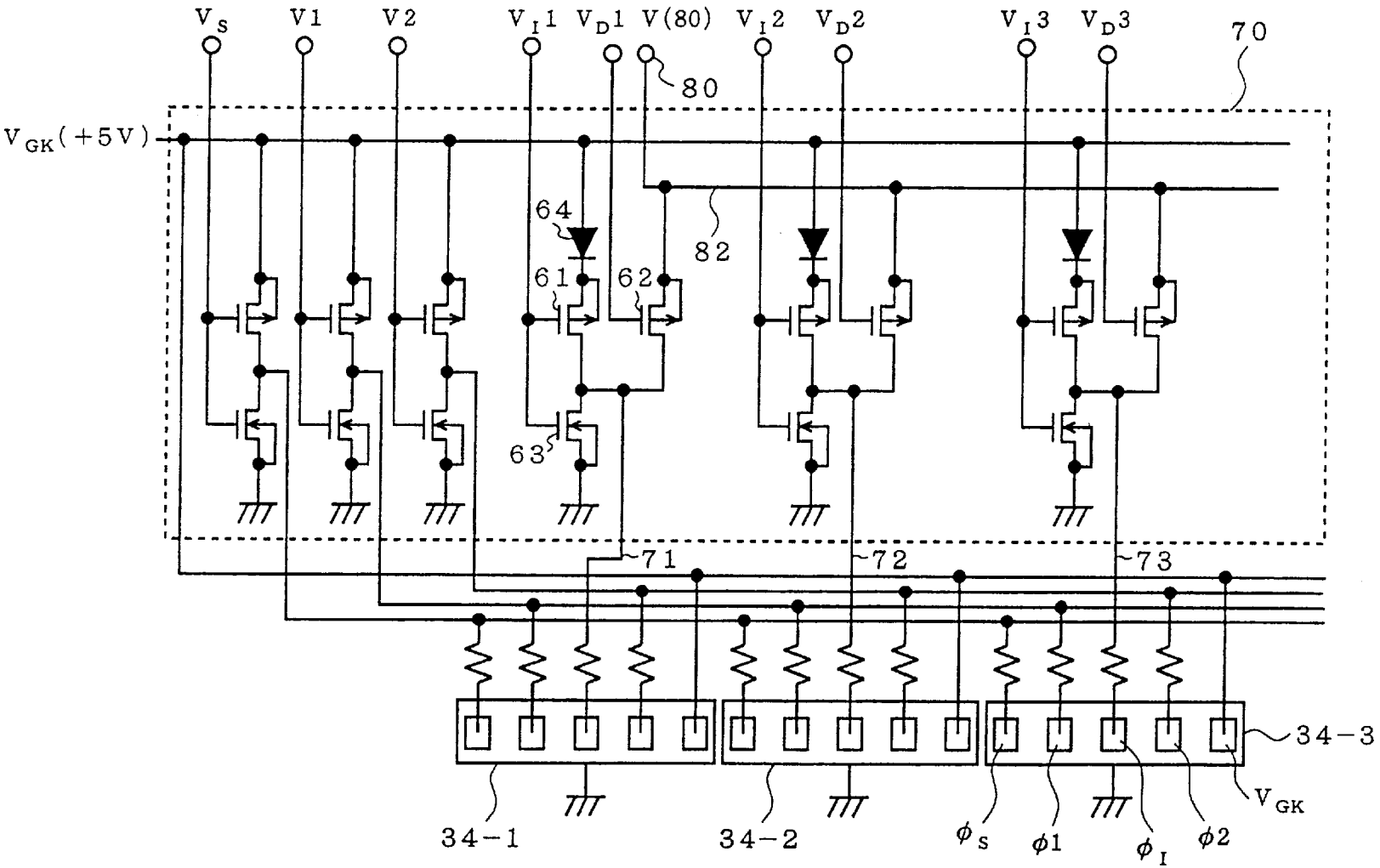
FIG. 14 is another example of a driver circuit.

While a diode is used for voltage shifting in the present embodiment, a resistor may also be used. Also, in the present embodiment, the correction of amounts of light among chips may be implemented. Forth Embodiment According to the driver circuit 68 shown in FIG. 11, both of the power supply for the NMOS transistor 62 and that for the CMOS inverter (61, 63) are taken from the power supply $V_{GK}$ (+5V). In the present embodiment, the driver circuit 70 shown in FIG. 14, the power supply line 82 for the NMOS transistor 62 is independently derived to a voltage terminal 80 for modulating a $\phi_I$ signal. Other structure is the same as that shown in FIG. 11, so that like element is designated by like reference character in FIG. 11. The reference numerals 71, 72 and 73 show $\phi_I$ signal output terminals, respectively.

Figure 15A:
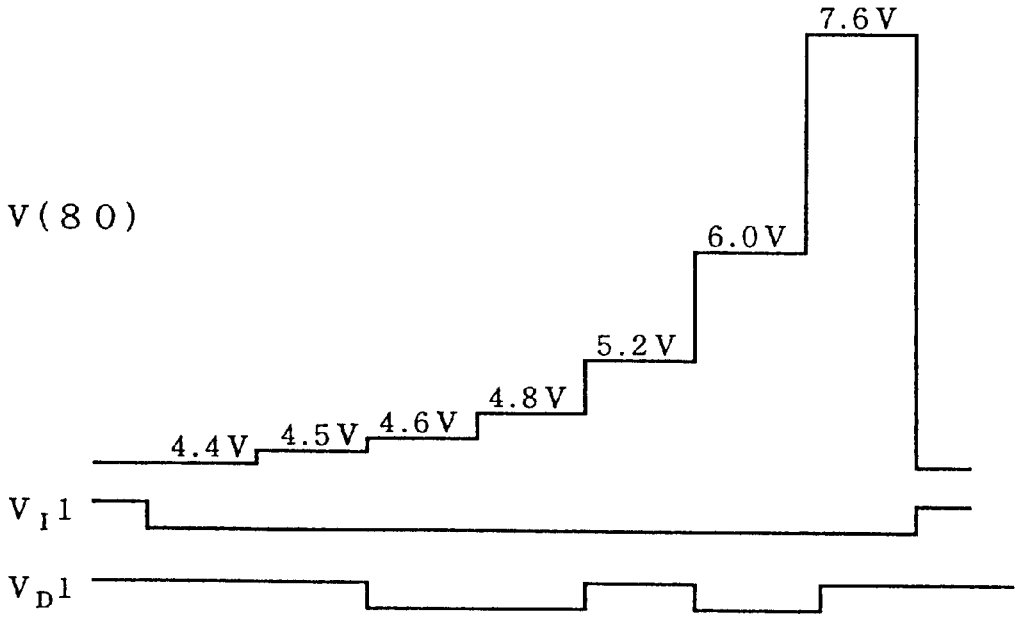
FIGS. 15A and 15B show the relationship between the voltage V(80) and V(71).

In the driver circuit 70 described above, a seven step-wise voltage V(80) as shown in FIG. 15A is applied to the voltage terminal 80. In this example, the voltage on Nth-step is set so as to be $4.4 +0.1\times(N-1)^2$).

Figure 15B:
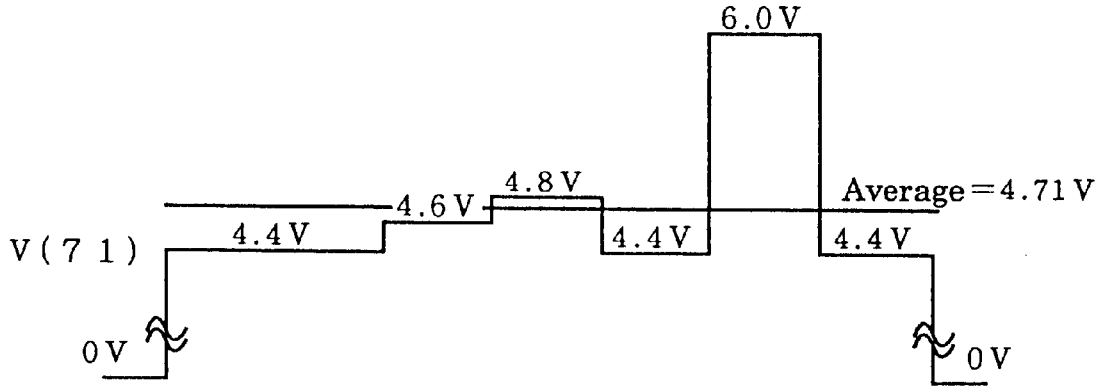

The voltage V(71) of the $\phi_I$ signal output terminal 71 may be varied by means of the signal $V_D$1. When the signal $V_I$1 is at a low level, the NMOS transistor 61 is turned on. At this time, if the signal $V_D$1 is at a high level, then the current flows through the diode 64 and the NMOS transistor 61 so that the voltage V(71) becomes 4.4v. If the signal $V_D$1 is at a low level, then the NMOS transistor 62 is turned on, therefore the voltage V(71) is determined by the voltage V(80) of the voltage terminal 80. This manner is shown in FIG. 15B, that is, the voltage V(80) is output to the terminal 71 when the signal $V_D$1 is at a low level.

According to such variation of the voltage V(71), the average voltage during the time duration when a light-emitting element is turned on becomes 4.71V. In this manner, the average voltage may be regulated at a resolution of 0.014V between 4.4V and 5.3V. Therefore, the accumulated amount of light may be regulated.

In this embodiment, while the minimum value of the voltage V(80) for regulating the amount of light is 4.4V, the minimum value may be further decreased by increasing the number of diodes 64.

Industrial Applicability

According to the present invention described above, the correction of amounts of light in the self-scanning light-emitting device may be implemented in a chip or among chips. As a result, the printing quality may be enhanced in the printer head using a self-scanning light-emitting device according to the present invention.

What is claimed is:

1. A self-scanning light-emitting device, comprising:

a self-scanning transfer element array having such a structure that a plurality of three-terminal transfer elements each having a control electrode for controlling threshold voltage or current are arranged, the control electrodes of the transfer elements neighbored to each other are connected via first electrical means, a power supply line is connected to the control electrodes via second electrical means, and clock lines are connected to one of two terminals other than the control electrode of each of the transfer elements;

a light-emitting element array having such a structure that a plurality of three-terminal light-emitting elements each having a control electrode for controlling threshold voltage or current are arranged, the control electrodes of the light-emitting element array are connected to the control electrodes of the transfer elements, and a line for applying a write signal connected to one of two terminals other than the control electrode of each of the light-emitting elements is provided; and a driver circuit for regulating the time duration of on-state of each of the light-emitting elements to correct amounts of light in every luminescent chip constituting the self-scanning light-emitting device so as to make the distribution of amounts of light among the chips uniform.

2. A self-scanning light-emitting device, comprising a self-scanning transfer element array having such a structure that a plurality of three-terminal transfer elements each having a control electrode for controlling threshold voltage or current are arranged, the control electrodes of the transfer elements neighbored to each other are connected via first electrical means, a power supply line is connected to the control electrodes via second electrical means, and clock lines are connected to one of two terminals other than the control electrode of each of the transfer elements;

a light-emitting element array having such a structure that a plurality of three-terminal light-emitting elements each having a control electrode for controlling threshold voltage or current are arranged, the control electrodes of the light-emitting element array are connected to the control electrodes of the transfer element array, and a line for applying a write signal connected to one of two terminals other than the control electrode of each of the light-emitting elements is provided; and a driver circuit for regulating the time duration of on-state of each of the light-emitting elements to correct amounts of light thereof in each of luminescent chips constituting the self-scanning light-emitting device so as to make the distribution of amounts of light in each luminescent chip uniform.

3. The self-scanning light-emitting device of claim 1 or 2, wherein the driver circuit includes a circuit for generating the write signal every luminescent chip, each said generating circuit holding a correction data for regulating the time duration of on-state of each of the light-emitting elements to correct amounts of light thereof.

4. The self-scanning light-emitting device of claim 3, wherein the correction data is formed by causing all of the light-emitting elements to turn on without correcting amounts of light thereof, and measuring amounts of light of turned-on light-emitting elements to obtain the correction data.

5. The self-scanning light-emitting device of claim 4, wherein both of the three-terminal transfer element and the three-terminal light-emitting elements are three-terminal light-emitting thyristors.

6. A self-scanning light-emitting device, comprising:

a self-scanning transfer element array having such a structure that a plurality of three-terminal transfer elements each having a control electrode for controlling threshold voltage or current are arranged, the control electrodes of the transfer elements neighbored to each other are connected via first electrical means, a power supply line is connected to the control electrodes via second electrical means, and clock lines are connected to one of two terminals other than the control electrode of each of the transfer elements;

a light-emitting element array having such a structure that a plurality of three-terminal light-emitting elements each having a control electrode for controlling threshold voltage or current are arranged, the control electrodes of the light-emitting element array are connected to the control electrodes of the transfer element array, and a line for applying a write signal connected to one of two terminals other than the control electrode of each of the light-emitting elements is provided; and a driver circuit for regulating the voltage of the write signal applied to each of the light-emitting elements to correct amounts of light thereof in each of luminescent chips constituting the self-scanning light-emitting device so as to make the distribution of amounts of light in one luminescent chip uniform.

7. A self-scanning light-emitting device, comprising:

a self-scanning transfer element array having such a structure that a plurality of three-terminal transfer elements each having a control electrode for controlling threshold voltage or current are arranged, the control electrodes of the transfer elements neighbored to each other are connected via first electrical means, a power supply line is connected to the control electrodes via second electrical means, and clock lines are connected to one of two terminals other than the control electrode of each of the transfer elements;

a light-emitting element array having such a structure that a plurality of three-terminal light-emitting elements each having a control electrode for controlling threshold voltage or current are arranged, the control electrodes of the light-emitting element array are connected to the control electrodes of the transfer element array, and a line for applying a write signal connected to one of two terminals other than the control electrode of each of the light-emitting elements is provided; and a driver circuit for regulating the voltage of the write signal applied to each of the light-emitting elements to correct amounts of light in every luminescent chip constituting the self-scanning light-emitting device so as to make the distribution of amounts of light among the chips uniform.

8. The self-scanning light-emitting device of claim 6 or 7, wherein the driver circuit includes a buffer for applying a voltage to the line for applying the write signal, the buffer being provided to every luminescent chip constituting the self-scanning light-emitting device, and a digital/analog converter provided on power supply side of the buffer, and wherein the output voltage of the buffer is regulated by selecting the input digital value to the converter.

9. The self-scanning light-emitting device of claim 8, wherein the buffer is a CMOS inverter-type buffer.

10. The self-scanning light-emitting device of claim 6 or 7, wherein the driver circuit includes a buffer for applying a voltage to the line applying for the write signal, the buffer comprises, a CMOS circuit consisting of a first and second MOS transistors, a voltage shifting element provided between the first MOS transistor and a power supply, and a third MOS transistor connected in parallel to a serial circuit of the voltage shifting element and the first MOS transistor, the conductivity type being the same as that of the first MOS transistor.

11. The self-scanning light-emitting device of claim 10, wherein the voltage shifting element is a diode or resistor.

12. The self-scanning light-emitting device of claim 6 or 7, wherein the driver circuit includes a buffer for applying a voltage to the line applying for the write signal, the buffer comprises, a CMOS circuit consisting of a first and second MOS transistors, a voltage shifting element provided between the first MOS transistor and a power supply, and a third MOS transistor connected between a junction point of the first and second MOS transistors and a power supply for modulating the write signal, the conductivity type being the same as that of the first MOS transistor.

13. The self-scanning light-emitting device of claim 12, wherein the voltage shifting element is a diode or resistor.

14. The self-scanning light-emitting device of claim 6 or 7, wherein both of the three-terminal transfer element and the three-terminal light-emitting elements are three-terminal light-emitting thyristors.

* * * * *

UNITED STATES PATENT AND TRADEMARK OFFICE

CERTIFICATE OF CORRECTION

PATENT NO. : 6,531,826 B1
DATED : March 11, 2003
INVENTOR(S) : Seiji Ohno et al.

It is certified that error appears in the above-identified patent and that said Letters Patent is hereby corrected as shown below:

Column 1,
Line 18, “292650” should read -- 2-92650 --.
Line 21, “selfscanning” should read -- self-scanning --.

Column 2,
Line 9, “turnon” should read -- turn on --.
Line 28, “G1,” should read -- G1 --.

Column 5,
Line 46, “100s” should read -- $\phi_s$ --.

Column 7,
Line 52, “100s” should read -- $\phi_s$ --.

Signed and Sealed this

Twentieth Day of April, 2004

JON W. DUDAS
*Acting Director of the United States Patent and Trademark Office*